US005915997A

United States Patent [19]

Lan-Jen

[11] Patent Number: 5,915,997

[45] **Date of Patent: *Jun. 29, 1999**

[54] THIN-TYPE PLUG

[76] Inventor: Tsang Lan-Jen, No. 1, Lane 199, Sec. 1, Min Chaun Road, Tainan, Taiwan

[ * ] Notice: This patent is subject to a terminal disclaimer.

[21] Appl. No.: 08/893,295

[22] Filed: Jul. 15, 1997

[51] Int. Cl.[6] ..... H01R 19/00

[52] U.S. Cl. ..... 439/694

[58] Field of Search ..... 439/484, 483, 439/160, 159, 157, 152, 258, 163, 694

[56] References Cited

U.S. PATENT DOCUMENTS 1,961,484 6/1934 Grant ..... 439/483
5,679,014 10/1997 Lan-Jen ..... 439/484

*Primary Examiner*—Paula Bradley
*Assistant Examiner*—Eugene G. Byrd
*Attorney, Agent, or Firm*—Rosenberg, Klein & Bilker

[57] ABSTRACT

The present invention relates to a thin-type plug, which is designed to have a pair of flexible wings for increasing the grasping area as plugging or pulling with hand. The two wings are molded on the main body of the plug, or combined on. For meeting the goal of saving effort, the mounted wings have extension ends just like levers when drawing off.

12 Claims, 16 Drawing Sheets

THIN-TYPE PLUG

BACKGROUND OF THE INVENTION

1. Field of the Invention

The present invention relates to a thin-type plug, and more particularly to a plug with a pair of flexible wings for increasing the grasping area, or by means of the leverage of the pair of wings, further to save pulling effort.

2. Description of Prior Art

For preventing children from pulling and playing the plug and from getting electric shock, a thin-type plug was designed, referring to FIG. 16, (referring to U.S. Pat. No. : 196,786), in which plug-in terminals A and the cord B are located into the mould, and moulded into a plastic plug by injection moulding directly, and the cord B is led out from the trail. This type of plug plugging into the plug socket appears so thin that children can not hold it and pull it out easily by hand. For the convenience of usage, a drag hook C is hung on the plastic body of the plug so that user can pull the plug easily from the socket by holding the drag hook C. The drag hook C can be withdrawn into the side rim of the plug in idle so that children are unable to reach it. But there are some shortcomings existing in the prior art as follows:

1. the drag hook C needs to be mounted on the plastic body of the plug after moulding, therefore it consumes more time in production, 2. because the drag hook C is made too thin to exert a force conformably with tip of the figure as pulling the plug by means of the drag hook C, especially when the joint area between the plug and socket is too tight.

OBJECTS AND SUMMARY OF THE INVENTION

It is therefore a main object of the present invention to provide a thin-type plug, which is designed to have a pair of flexible wings for increasing the grasping area as plugging or pulling with hand. The two wings are moulded on the main body of the plug, or combined on. For meeting the goal of saving effort, the mounted wings have extension ends just like levers when drawing off.

DETAILED DESCRIPTION OF PREFERRED EMBODIMENTS

Figure 1:
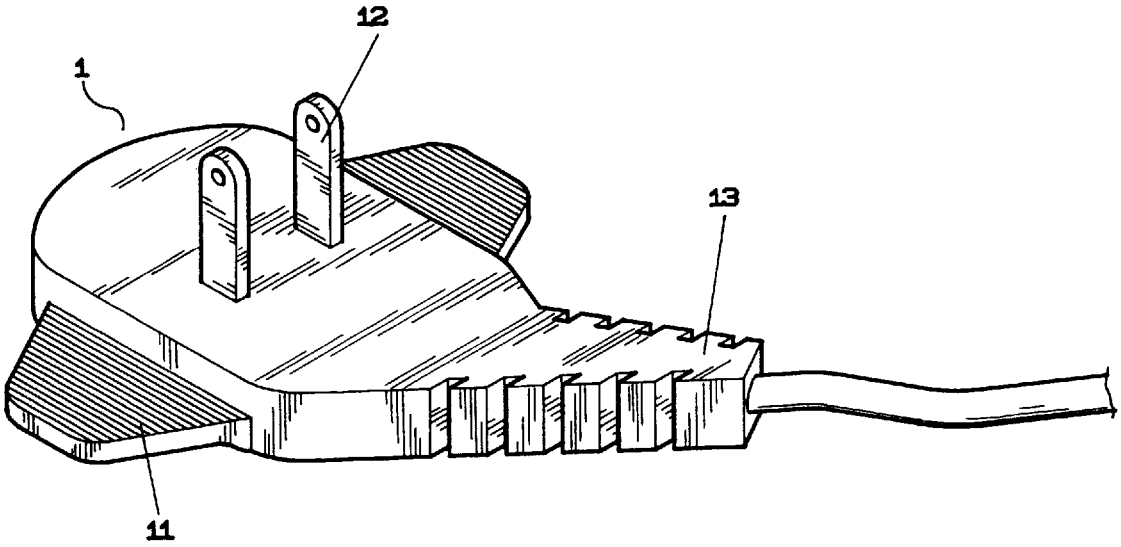
FIG. 1 is a solid view of the present invention.

Referring to FIG. 1, the present invention provides a thin-type plug 1 with a pair of wings 11 along the side edges, wherein the wings 11 are flexible and elastic in order to restore its original position automatically, and the bottom sides of the wings 11 is formed to a corrugated surface to increase friction, or anti-slip surface. Two plug-in terminals 12 are built upon one side, and a trail 13 is formed into an angle at one end for leading the cord out.

Figure 2:
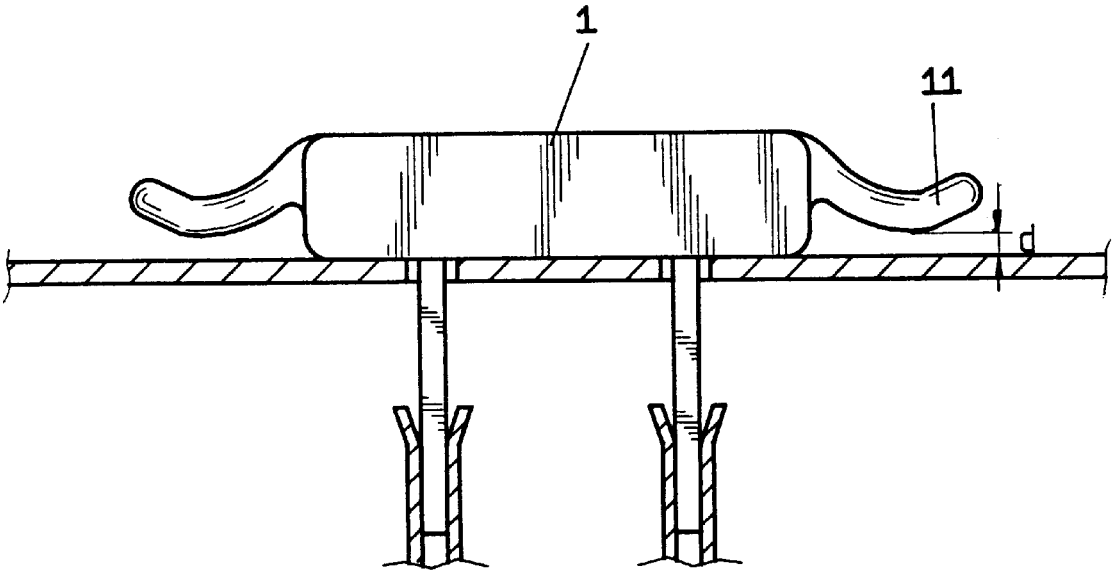
FIG. 2 is a side view showing the operation of the present invention.
Figure 3:
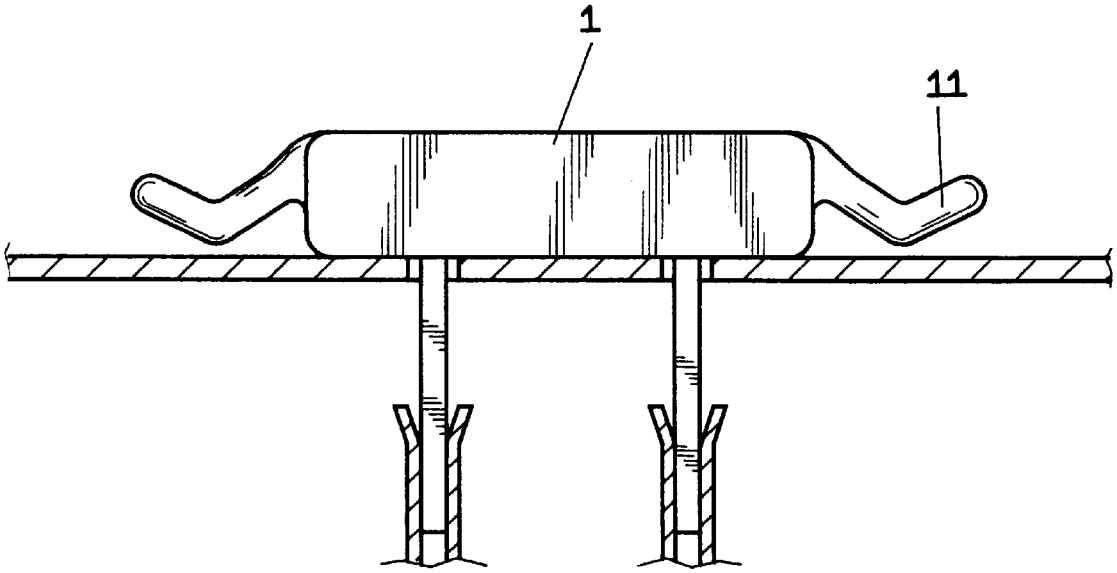
FIG. 3 is a side view showing the change of the wings of the present invention.

In practising, referring to FIG. 2, the thin-type plug 1 is plugged into the power socket with the two plug-in terminals 12, meanwhile the wings 11 spread to both sides horizontally and approaching the surface of the socket board maintaining a space "D" providing an essential space for figures catching on. For the convenience of grasping the wings by figures, referring to FIG. 3, the wings 11 is formed into bending upward at the tip portions to get a bigger space for the figures picking up.

Figure 4:
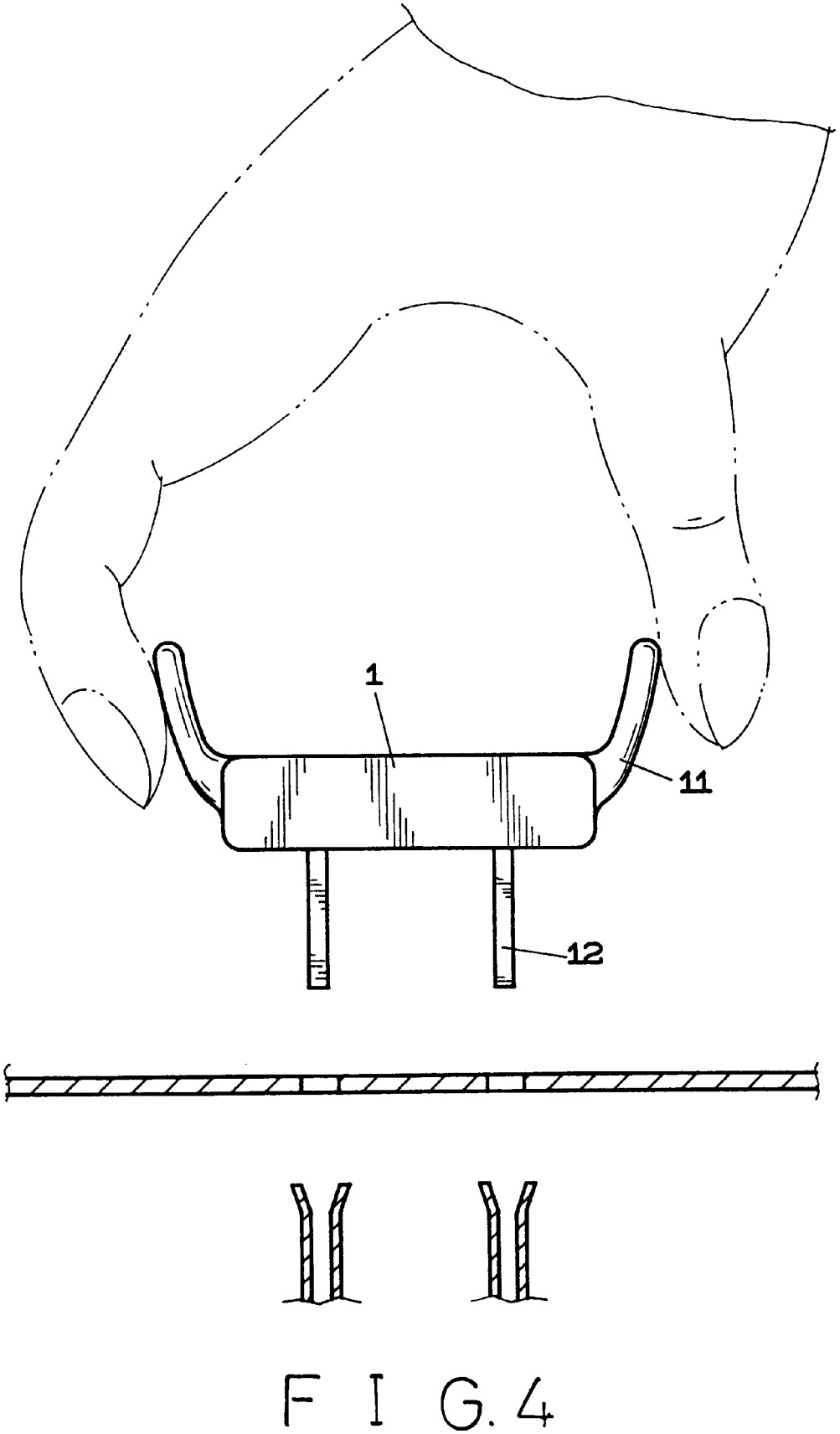
FIG. 4 is a side view showing the action of the present invention.

When grasping the thin-type plug I with the figures, as showing in FIG. 4, the figures bend the wings upward by exerting efforts on the edges of the wings increasing the grasping areas greatly so that the figures can catch the wider sides of the wings 11 fully, by means of elasticity of the wings 11, and the surfaces of the wings are treated in anti-slip process, the figures hold the wings 11 more smoothly, in order to draw or plug the thin-type plug 1 out or in socket board easily.

Figure 5:
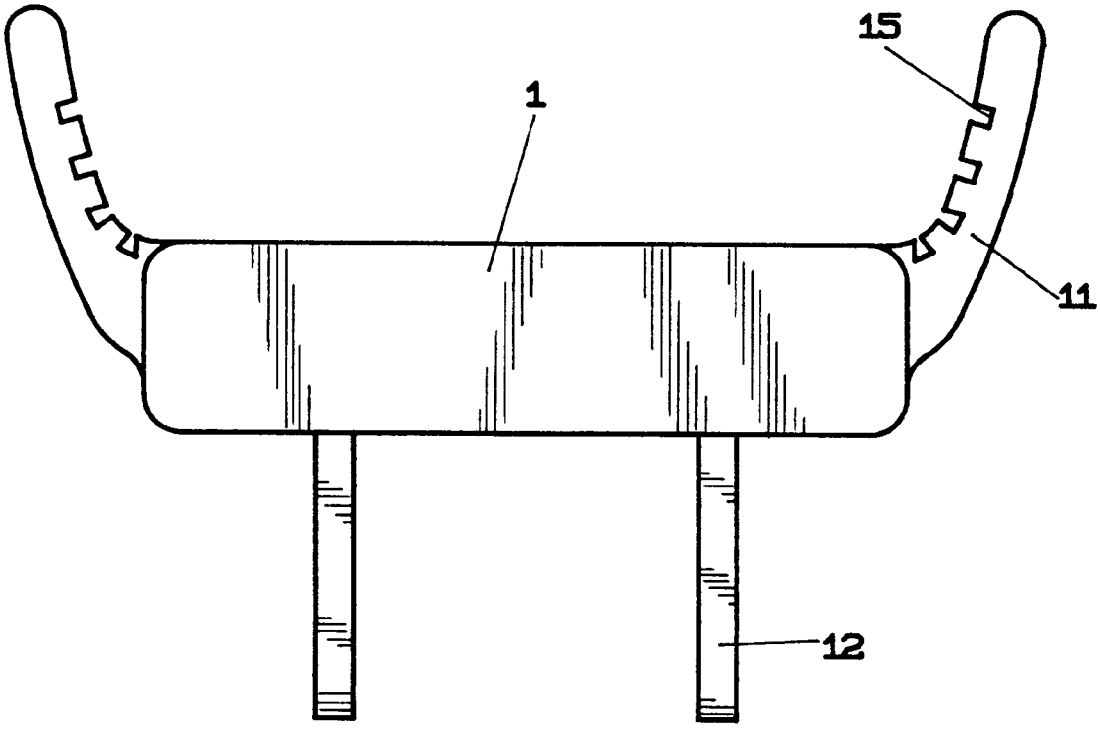
FIG. 5 is a side view showing the fillisters on the wings of the present invention (1)
Figure 6:
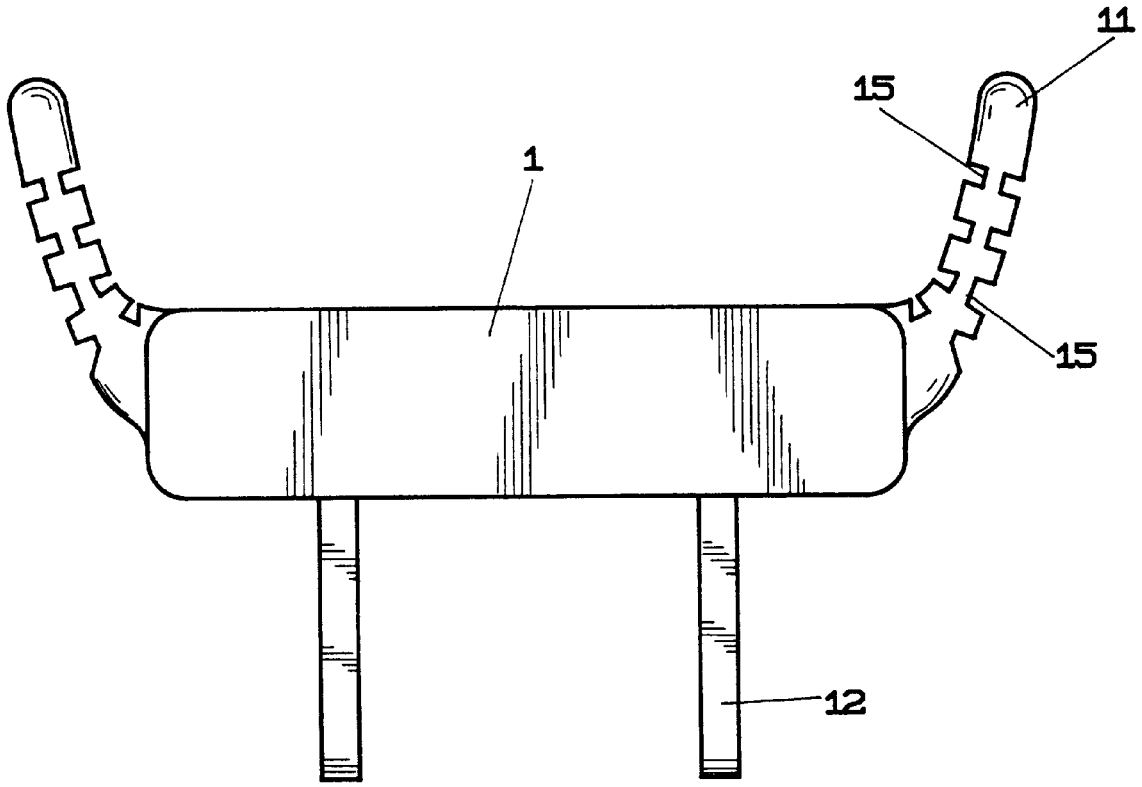
FIG. 6 is a side view showing the fillisters on the wings of the present invention (2)

If the wings 11 are thicker, as showing in FIG. 5, the surfaces of the wings 11 for touching against with the figures can be formed with several fillisters 15, or on both sides of the wing 11 (as shown in FIG. 6), especially to the thicker wings 11.

Figure 7:
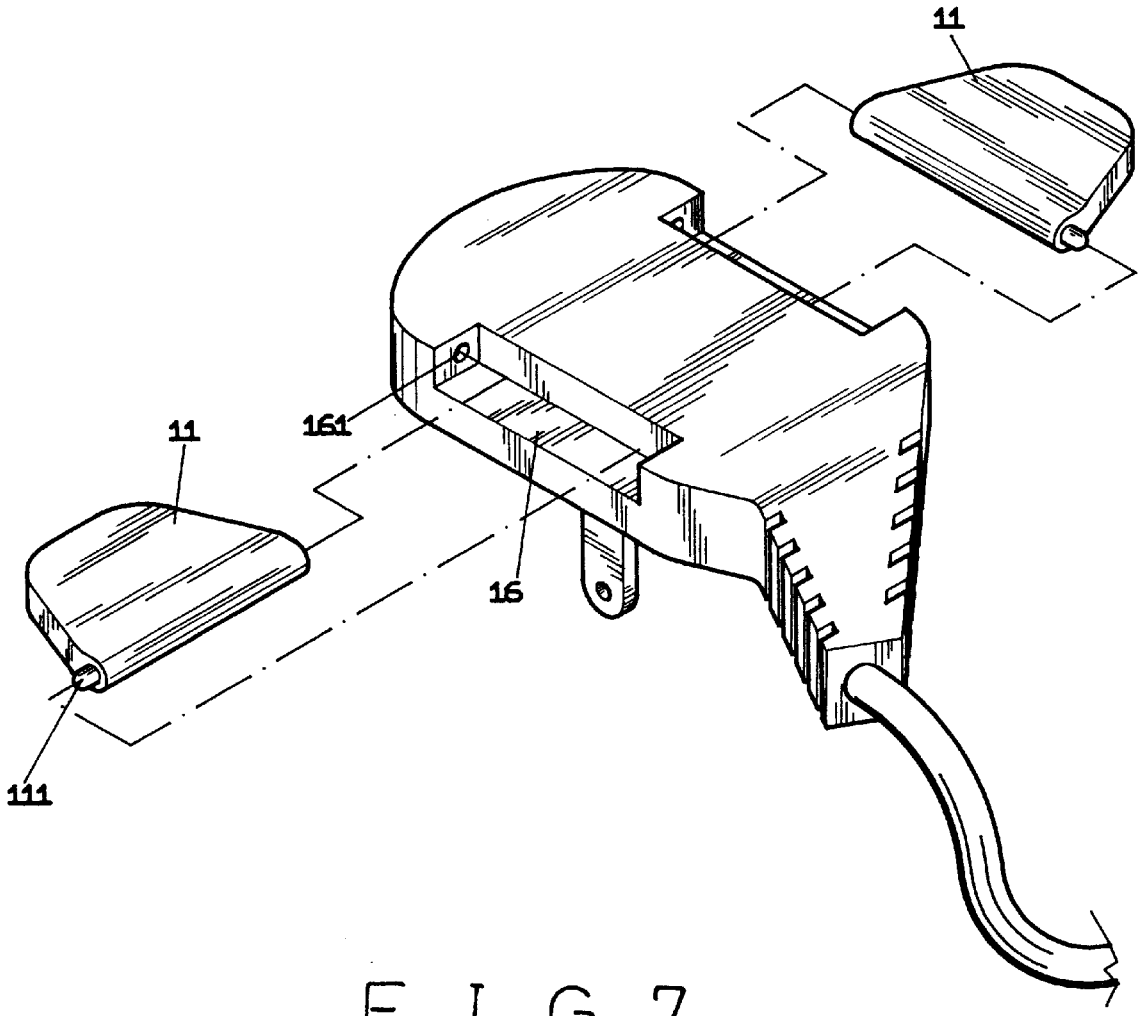
FIG. 7 is an exploded view showing other operation of the present invention (1)
Figure 8:
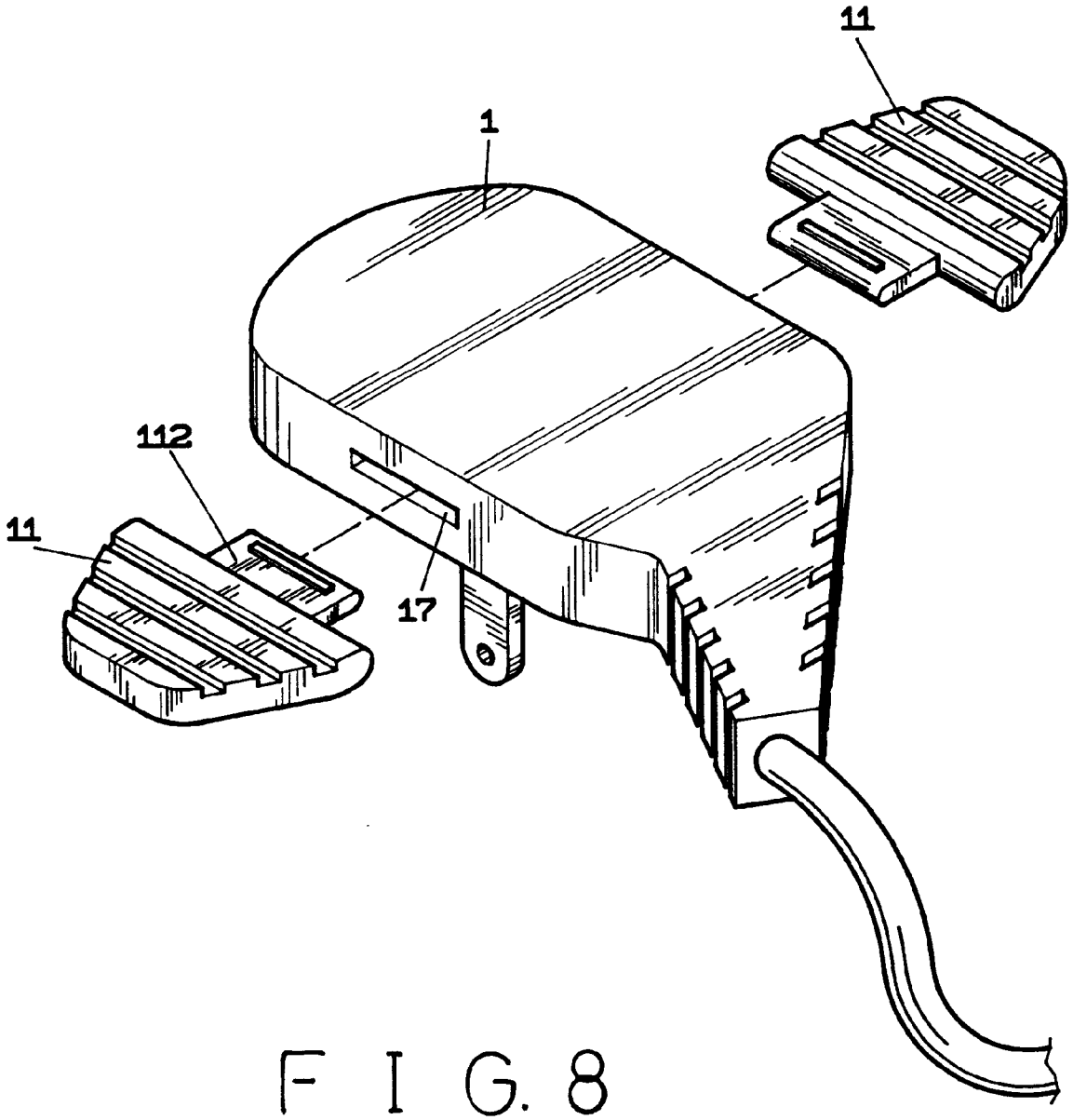
FIG. 8 is an exploded view showing other operation of the present invention (2)

On the other way, the wings 11 can be made up combination components, as shown in FIG. 7, the thin-type plug 1 has two mounting slots 16 at both sides, therein two tip holes 161 are formed at both ends of the mounting slot 16 separately. Corresponding to the mounting slot 16 and the tip holes 161, there are two lug bowels 111 formed on both tip ends of the joint portion of the wing 11 for pivoting insert into the tip holes 161. Mounting on the wings 11, depending on the purpose, they can lay horizontally or stand up vertically as the performance of above-described wings 11. Referring to FIG. 8, the joints between the wings 11 and the thin-type plug 1 can be in plug-socket joint, as the thin-type plug 1 has two joining slots 17 on both sides separately, the wing 11 has a plug-in strip 112 coordinating to the joining slot 17 of the thin-type plug 1. By means of the flexibility of the wings 11, the wings 11 take the task as above-described wings.

Figure 9:
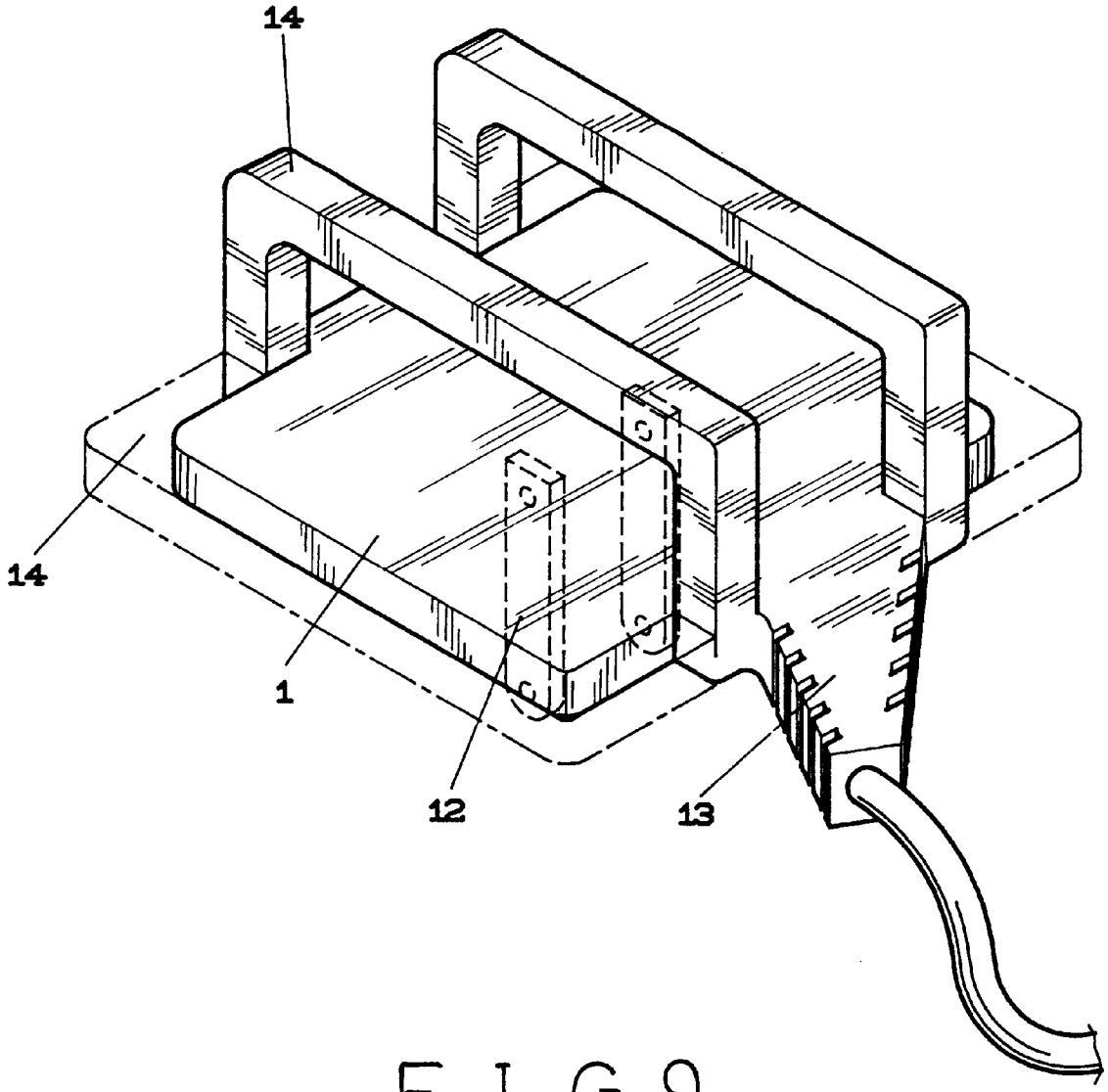
FIG. 9 is an exploded view showing other operation of the present invention (3)

Besides above-mentioned two types of mounted wings, a couple of flexible drag hooks 14 connecting on both sides of the main body of the thin-type plug 1 separately, referring to FIG. 9, can be drew up as external forces exerting on them, whereas, when the external forces is released, they resume to original position spreading horizontally.

Figure 10:
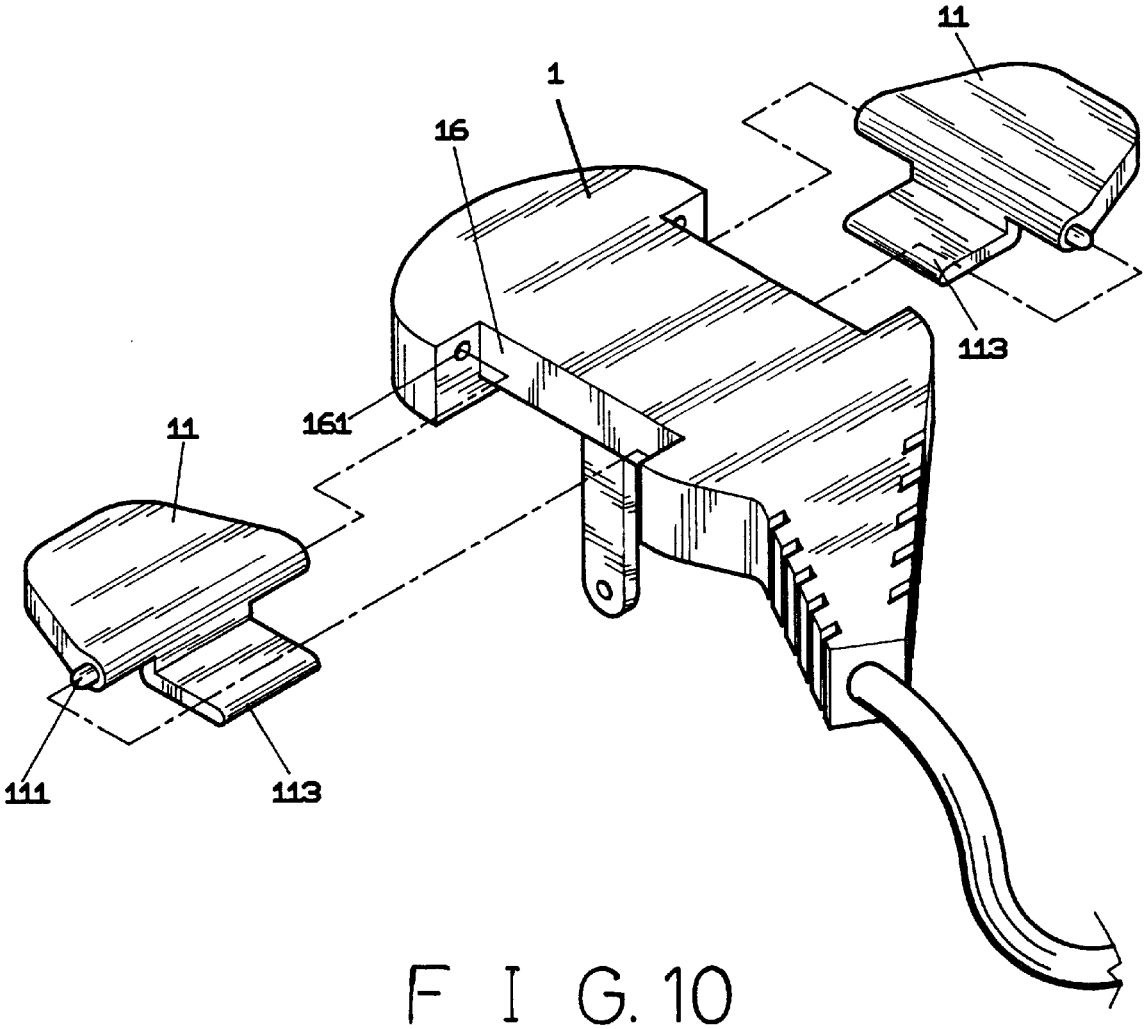
FIG. 10 is an exploded view showing other operation of the present invention (4)
Figure 11:
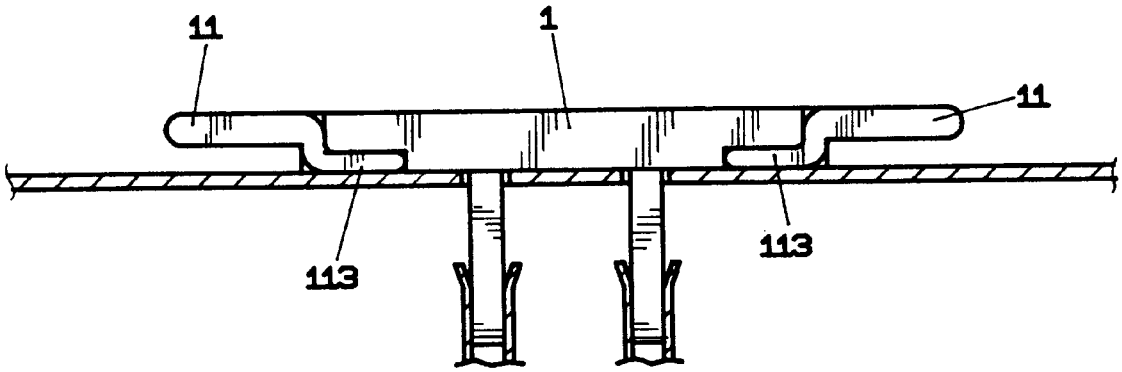
FIG. 11 is a side view showing other operation of the present invention (5)
Figure 12:
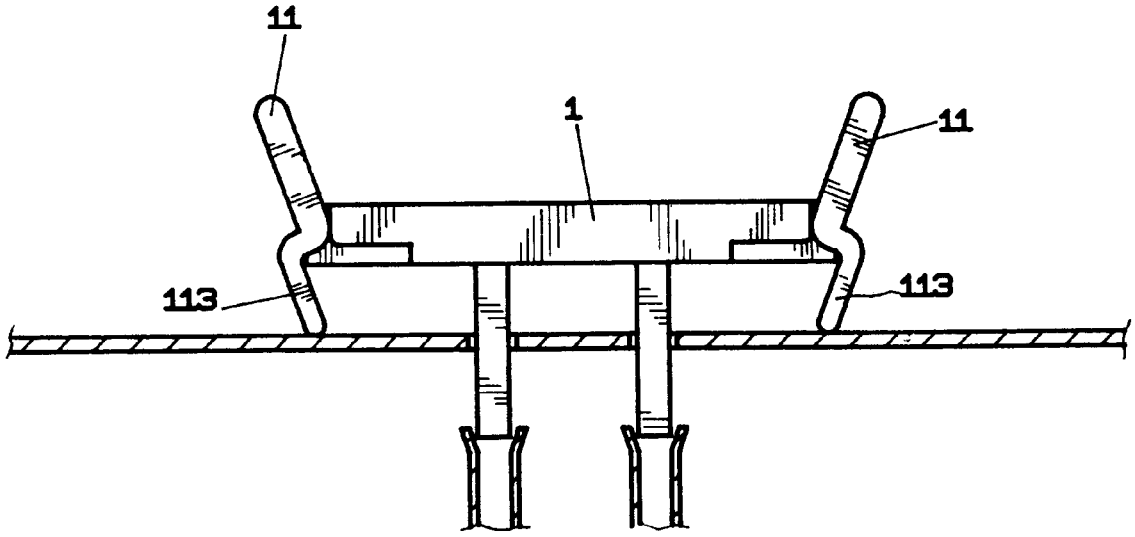
FIG. 12 is a side view showing the action of the lever-type wings of present invention.

Based upon the operation shown in FIG. 7, the hanged wing 11 extends a pry strip 113 at bottom side between two lug bowels 111, co-ordinating to it, the thin-type plug 1 has two open slots under the both mounting slots 16 separately for containing the pry strips 113 of the wings 11, as shown in FIG. 10. In practising, referring to FIG. 11, as the wings 11 laying levelly, the pry strips 113 are withdrawn in the open slots pre-formed at the bottom side of the thin-type plug 1. But when the wings 11 are bent upward, the wings 11 pivot around the lug bowels 111 so that the pry strips 113 working as a saving effort lever butt on the surface of the socket board to lift the main body of the thin-type plug 1 up to pull off easily(as shown in FIG. 12).

Figure 13:
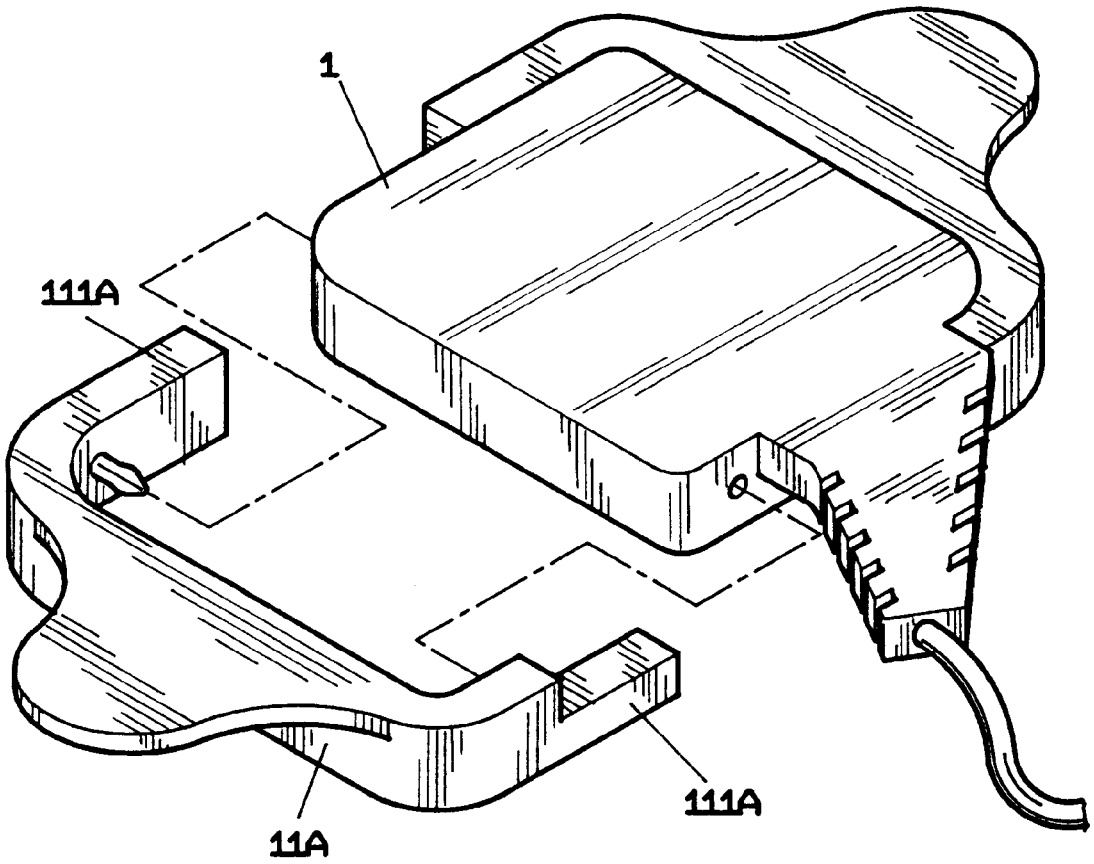
FIG. 13 is an exploded view showing other operation of the present invention (6)

In the same way, two N-shaped wings 11A, as shown in FIG. 13, are hanged on both sides of the main body of the thin-type plug 1 respectively, and from the hanged ends the extension crowbars 111A to butt on the surface of the socket board as the wings 11A standing up so that the plug is pull off.

Figure 14:
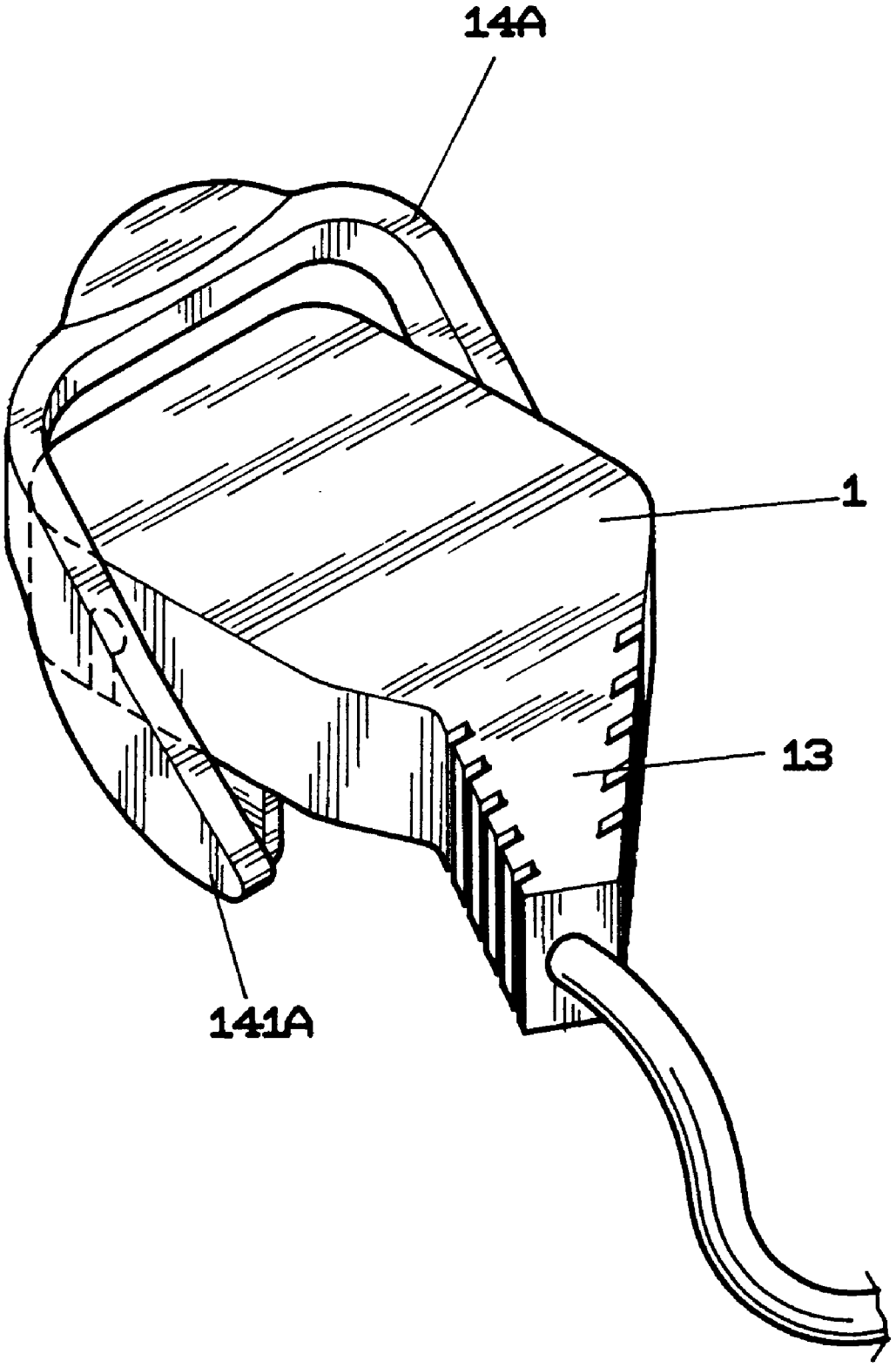
FIG. 14 is a solid view showing other operation of the present invention (7)
Figure 15:
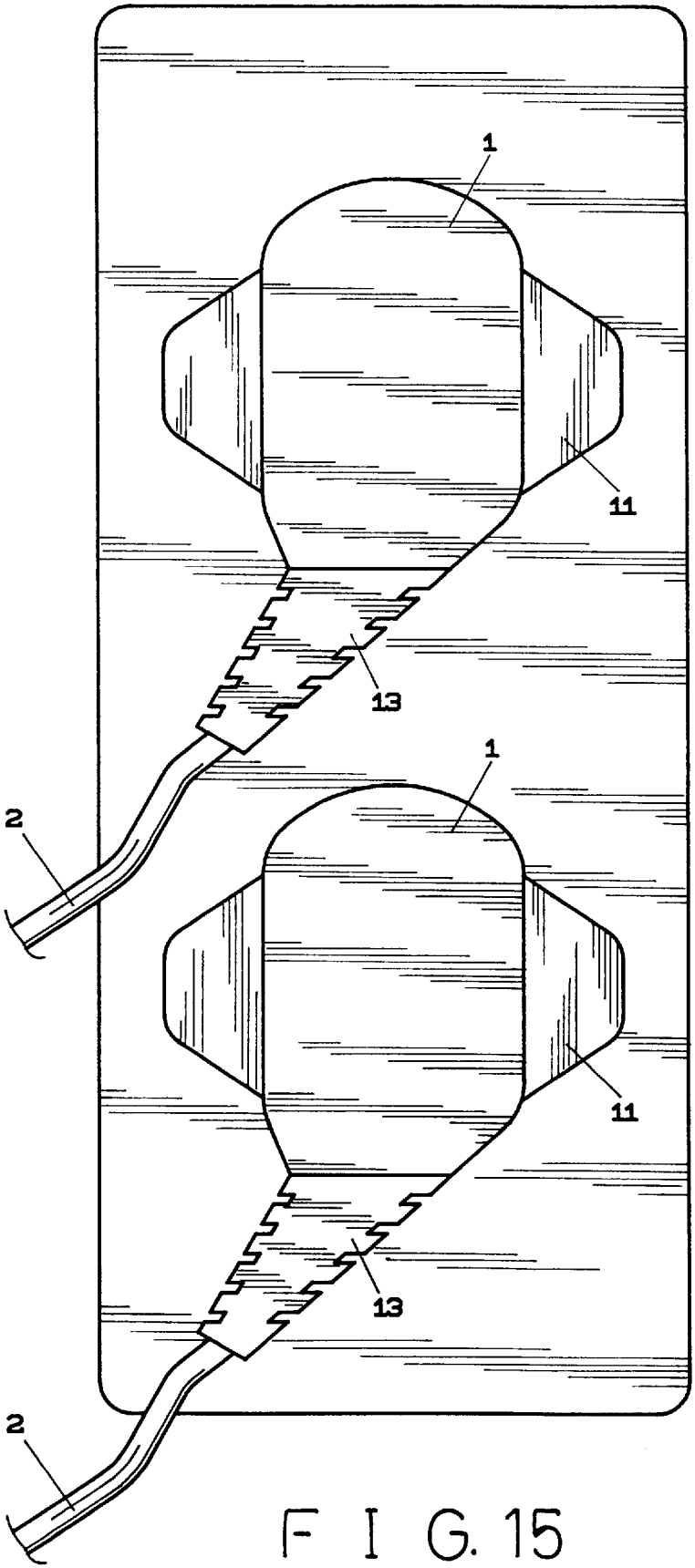
FIG. 15 is a top view showing arrangement in practising of the present invention.
Figure 16:
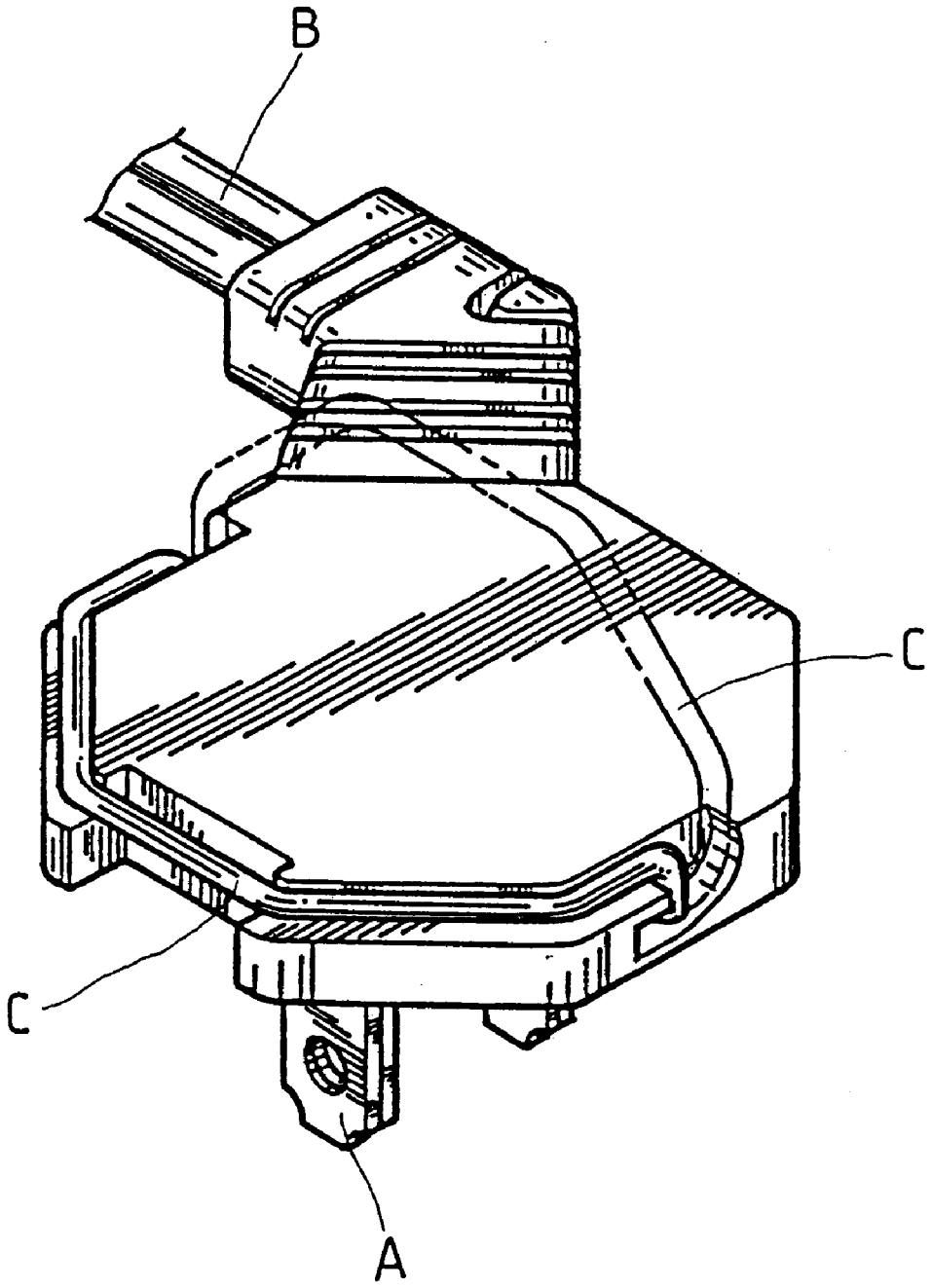
FIG. 16 (PRIOR ART)
FIG. 16 is a solid view of prior art.

On the other way, the lever-style wings can be made up a reversed U-shape single curved lever 14A, as shown in FIG. 14, and two extension end 141A are stretched to the rear side from the pivoting points as two levers for butting on the surface of the socket board to pull the plug 1 off When several thin-type plugs plug on a socket board in a row, as shown in FIG. 15, due to the angle kept in the end of the main body of the thin-type plug 1 leading out the cord, they can not interfere with each other.

All above-mentioned operations can not only be used as of two plug-in terminals of plug, but also of three or four terminals of plug.

Some advantages exist in present invention as follows:

1. as plugging in, the plug sticking on the surface of the board is so thin that it keeps in a smaller space and very safety;

2. in pulling out, the wings provide a bigger grasping space to make the holding more stable.

3. the anti-slip area on the wings supply a smoother grasping.

4. the restoring forces of the bent wings can make the wings touch against the figures more tightly and comfortably.

5. it not only keeps all advantages of the conventional thin-type plugs, but also increases saving effort advantage with the lever-style wings.

I claim:

1. A thin-type plug consisting of a main body and two flexible wings, in which said two flexible wings being bend upward as grasping or lay down as idle.

2. The thin-type plug as claimed in claim 1, wherein said wings is made up integrally, by means of flexibility and elasticity, standing up or resuming laying down.

3. The thin-type plug as claimed in claim 1, wherein said wings is made up combination components for mounting on said main body in hanging joint enabling to turn upward or lay down.

4. The thin-type plug as claimed in claim 1, wherein said separated wings and said main body are joined in plug-socket joint, as two joining slots on two sides of said main body and the plugging strip on said wing, by means of flexibility and elasticity, standing up or resuming laying down.

5. The thin-type plug as claimed in claim 1, wherein said wings is made up a couple of flexible drag hooks connecting on both sides of said main body by moulding, by means of flexibility and elasticity, standing up or resuming laying down.

6. The thin-type plug as claimed in claim 3, wherein said hanged wing extends a pry strip from the pivoting axis to the opposite side so that it can work as a pry bar to lift the plug up fluently when the wing is bent up.

7. The thin-type plug as claimed in claim 3 or claim 6, wherein said wing can be made up one or two N-shaped curved levers attaching on the rim of the main body.

8. The thin-type plug as claimed in claim 1, wherein at least one side surface of said wing is formed an anti-slip surface with great friction.

9. The thin-type plug as claimed in claim 2 or claim 4, wherein said wing is formed with several fillisters on the top, below, or both surfaces.

10. The thin-type plug as claimed in claim 1, wherein as plugging on said socket board, said wings of said plug maintain a space providing an essential space for figures catching on.

11. The thin-type plug as claimed in claim 1, wherein the tip end of said wing is formed into an angle bending up.

12. The thin-type plug as claimed in claim 1, wherein a trail is formed into an angle at one end for leading the cord out on the plug body.

* * * * *